US006243644B1

(12) United States Patent
Dengler

(10) Patent No.: US 6,243,644 B1
(45) Date of Patent: Jun. 5, 2001

(54) TRAFFIC MONITORING DEVICE ATTACHED TO A TRAFFIC SIGN

(76) Inventor: James S. Dengler, 1305 Nye St., San Rafael, CA (US) 94901

( * ) Notice: Subject to any disclaimer, the term of this patent is extended or adjusted under 35 U.S.C. 154(b) by 0 days.

(21) Appl. No.: 09/387,940

(22) Filed: Sep. 1, 1999

Related U.S. Application Data

(60) Provisional application No. 60/111,180, filed on Dec. 7, 1998.

(51) Int. Cl.[7] ..... G08G 1/01

(52) U.S. Cl. ..... 701/117; 340/907; 340/933

(58) Field of Search ..... 701/117; 340/933, 340/907, 943, 917, 919; 40/612

(56) References Cited

U.S. PATENT DOCUMENTS 4,788,711 * 11/1988 Nasco, Jr. ..... 455/404
5,276,424 * 1/1994 Hegemann ..... 340/321
5,448,219 * 9/1995 Yoshikawa et al. ..... 340/436
5,734,339 * 3/1998 Ogle ..... 340/944
5,889,477 * 3/1999 Fastenrath ..... 340/905
6,005,491 * 12/1999 Kopchak et al. ..... 340/907

* cited by examiner

*Primary Examiner*—Michael J. Zanelli
(74) *Attorney, Agent, or Firm*—Jack Lo

(57) ABSTRACT

A traffic monitoring device is comprised of a housing for mounting on an existing stop sign. A red lamp attached under the housing is for being positioned in front of the sign above the word "Stop." When approaching traffic or pedestrians are detected by motion detectors on the housing, the lamp is flashed several times to positively alert drivers to the presence of the sign, and to convey the importance of stopping. Detected traffic movements are stored in memory, and intermittently transmitted to a remote monitoring station with a telephone transceiver. A tamper alert is activated by a tamper switch positioned against a cover on the housing, and deactivated by a keyed control switch. A panic switch and speakerphone for being attached to a supporting post of the stop sign is available to drivers and pedestrians for communicating with an emergency response center. In a second embodiment, the sign is comprised of a housing in the shape of a stop sign enclosing the electronics. In a third embodiment, the sign is comprised of a housing in the shape of a school crossing sign enclosing the electronics.

19 Claims, 4 Drawing Sheets

TRAFFIC MONITORING DEVICE ATTACHED TO A TRAFFIC SIGN

CROSS REFERENCE TO RELATED APPLICATIONS

The benefit of provisional patent application No. 60/111,180, filed Dec. 7, 1998, is claimed.

BACKGROUND OF THE INVENTION

1. Field of the Invention

This invention relates generally to traffic monitoring devices.

2. Prior Art

A stop sign is a simple painted plate on a support post positioned at a street intersection. Aside from its red color, it is not conspicuous enough to positively attract the attention of drivers or to convey the importance of stopping. Accidents can happen when a driver fails to notice a stop sign, or simply ignores it.

OBJECTS OF THE INVENTION

Accordingly, objects of the present traffic monitoring device are:

- to positively alert drivers to the presence of a stop sign or other traffic sign;
- to convey the importance of stopping to drivers who might otherwise ignore the sign;
- to be self-powered;
- to provide an alert which is automatically activated by oncoming traffic or approaching pedestrians;
- to monitor and record traffic activity;
- to transmit the traffic activity information to a remote monitoring station;
- to provide a communication link for drivers or pedestrians with an emergency call center;
- to be tamper resistant; and
- to be easily retrofitted to existing stop signs.

Further objects of the present invention will become apparent from a consideration of the drawings and ensuing description.

BRIEF SUMMARY OF THE INVENTION

A traffic monitoring device is comprised of a housing for mounting on an existing stop sign. A red lamp attached under the housing is for being positioned in front of the sign above the word "Stop." When approaching traffic or pedestrians are detected by motion detectors on the housing, the lamp is flashed several times to positively alert drivers to the presence of the sign, and to convey the importance of stopping. Detected traffic movements are stored in memory, and intermittently transmitted to a remote monitoring station with a telephone transceiver. A tamper alert is activated by a tamper switch positioned against a cover on the housing, and deactivated by a keyed control switch. A panic switch and speakerphone for being attached to a supporting post of the stop sign is available to drivers and pedestrians for communicating with an emergency response center. In a second embodiment, the sign is comprised of a housing in the shape of a stop sign enclosing the electronics. In a third embodiment, the sign is comprised of a housing in the shape of a school crossing sign enclosing the electronics.

DRAWING REFERENCE NUMERALS

| | | | |
|---|---|---|---|
| 10. | Traffic Monitoring Device | 11. | Housing |
| 12. | Front Brackets | 13. | Rear Brackets |
| 14. | Stop Sign | 15. | Lamp |
| 16. | Motion Detectors | 17. | Solar Panel |
| 18. | Pivotable Bracket | 19. | Post |
| 20. | Antenna | 21. | Batteries |
| 22. | Panic Switch | 23. | Speakerphone |
| 24. | Support Post | 25. | Charger |
| 26. | Controller | 27. | Memory |
| 28. | Tamper Switch | 29. | Control Switch |
| 30. | Telephone Transceiver | 31. | Road |
| 32. | Sidewalk | 33. | Housing |
| 34. | Background | 35. | Border |
| 36. | Insignia | 37. | Solar Panel |
| 38. | Front Motion Detector | 39. | Side Motion Detector |
| 40. | Lamps | 41. | Housing |
| 42. | Background | 43. | Insignia |
| 44. | Housing | 45. | Insignia |
| 46. | Solar Panel | 47. | Front Motion Detector |
| 48. | Side Motion Detector | 49. | Lamps |

DETAILED DESCRIPTION OF THE INVENTION

Figure 1:
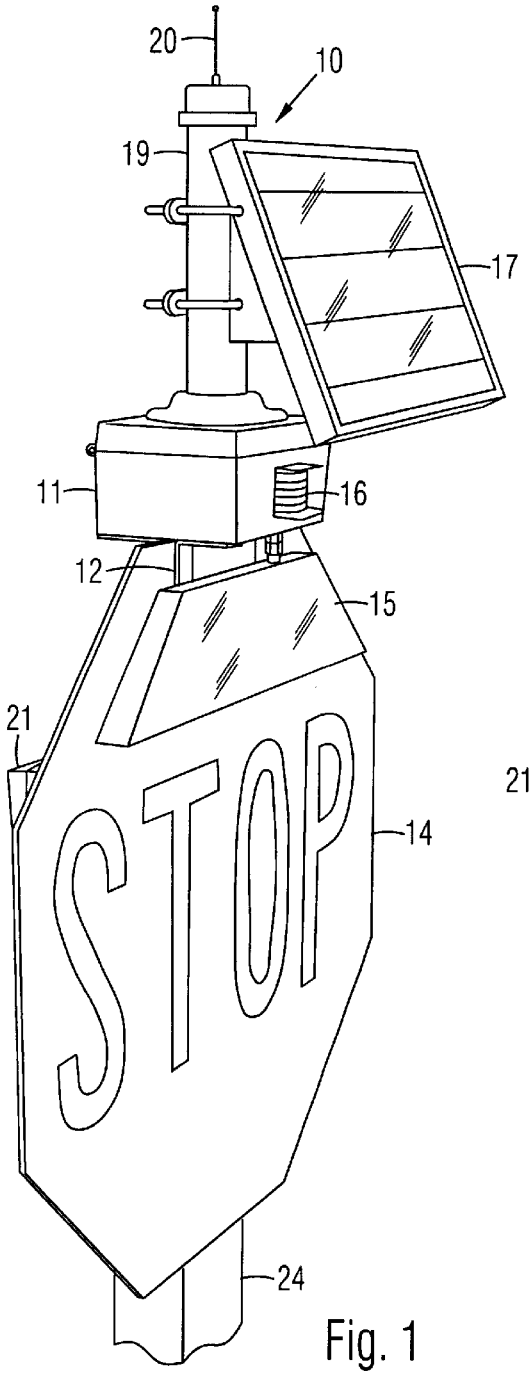
FIG. 1 is a front perspective view of a first embodiment of the present traffic monitoring device attached to a traffic sign.
Figure 2:
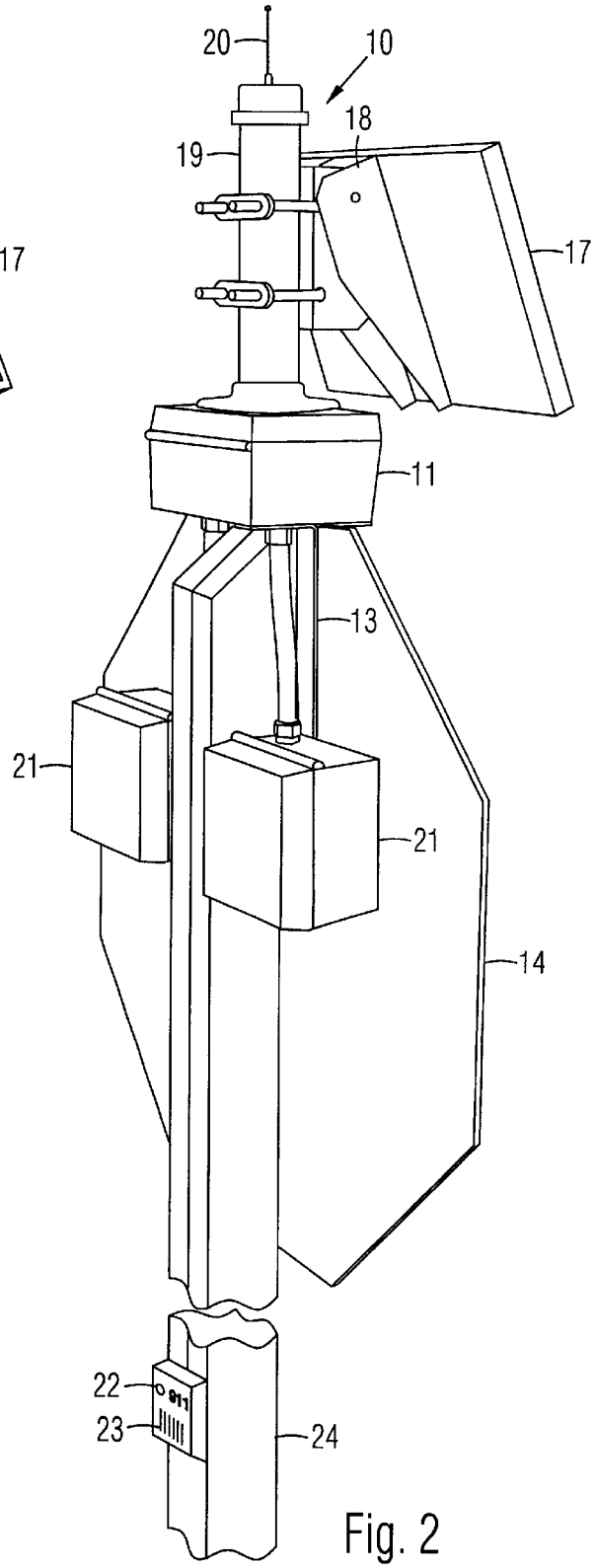
FIG. 2 is a rear perspective view of the traffic monitoring device of FIG. 1.

FIGS. 1–2:

A first embodiment of a traffic monitoring device 10 is shown in the front and rear perspective views in FIGS. 1–2. It includes a housing 11 with front brackets 12 and rear brackets 13 for being easily mounted on the top edge of a conventional stop sign 14 with tamper resistant fasteners. A lamp 15, which is preferably red, is attached to front brackets 12 and positioned above the word "STOP" on sign 14. A pair of motion sensors 16 (one shown) are preferably attached to the front and right sides of housing 11. A solar cell 17 on a pivotable bracket 18 is attached to a post 19 extending from the top of housing 11. An antenna 20 is attached on top of post 19. A pair of batteries 21 are attached to rear brackets 13 and positioned behind stop sign 14. A panic switch 22 and a speakerphone 23 are for being attached to an intermediate position on a support post 24 of stop sign 14.

Figure 3:
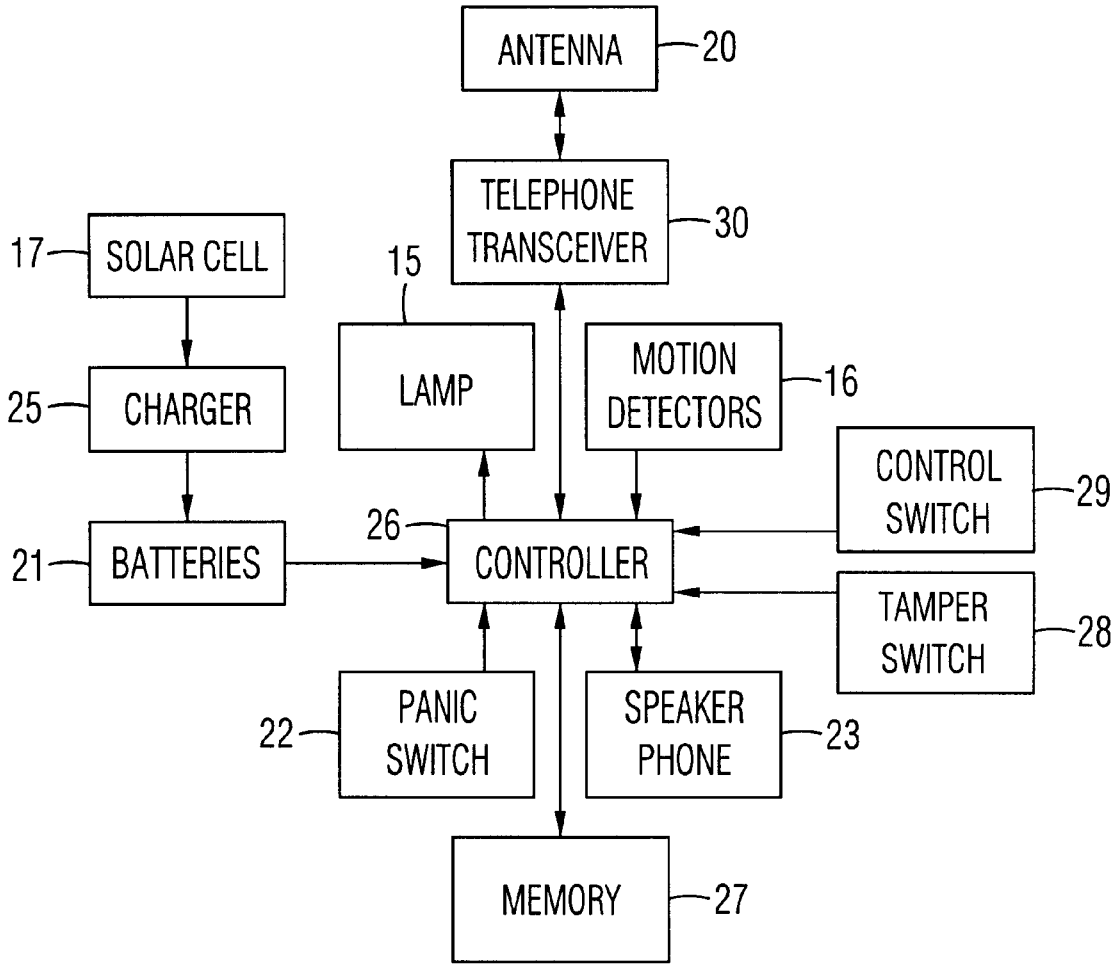
FIG. 3 is an electrical block diagram of the traffic monitoring device.
Figure 4:
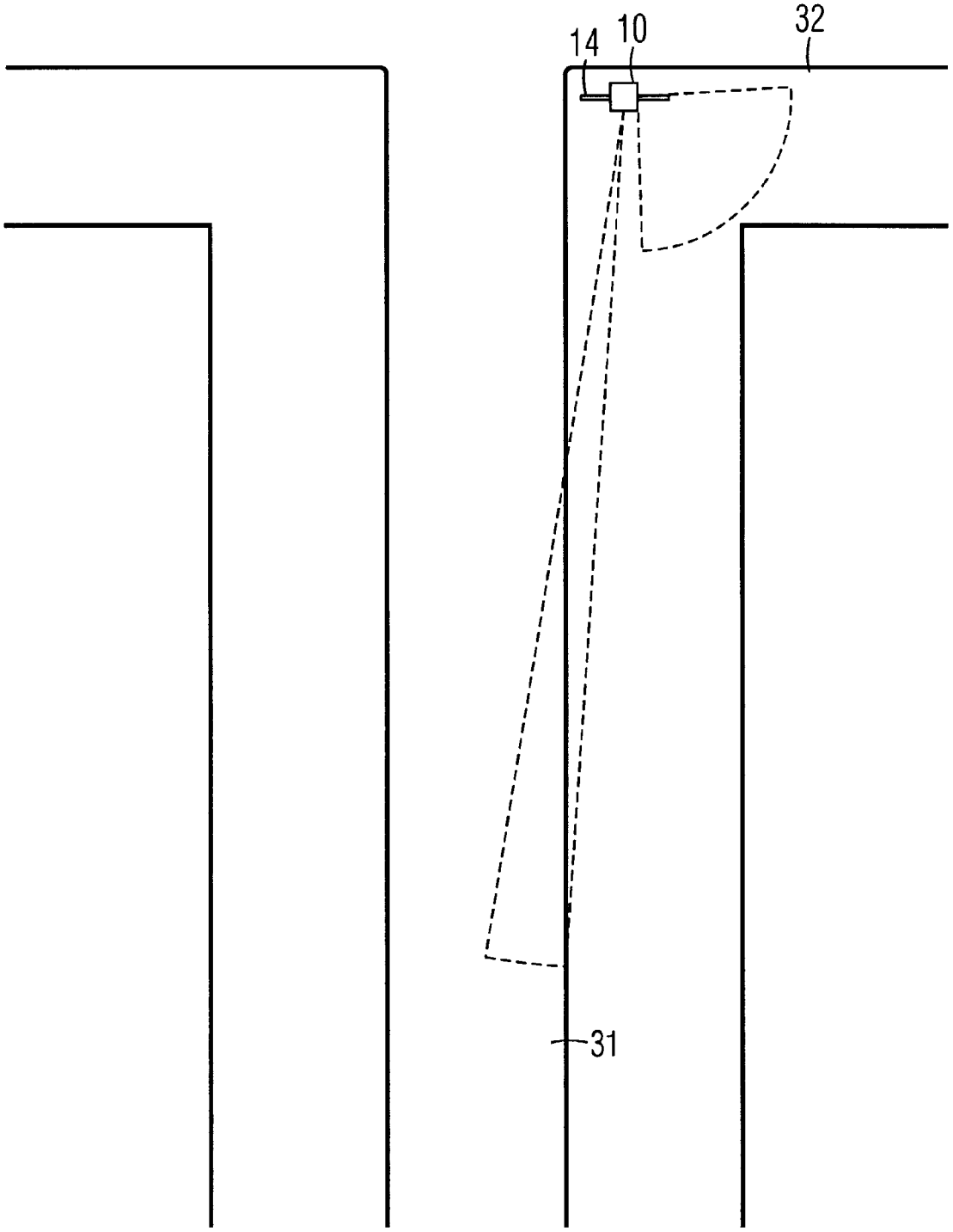
FIG. 4 is a top view of the traffic monitoring device installed on a stop sign at a street intersection.

FIG. 3:

An electrical block diagram of the traffic monitoring device is shown in FIG. 3. Batteries 21 are charged by solar cell 17 through a charger 25, so that the traffic monitoring device can be installed on stop signs anywhere without having to be wired for power. When approaching traffic or pedestrians are detected by motion detectors 16, lamp 15 is flashed several times by a controller 26 to positively drivers to the presence of the stop sign, and to convey the importance of stopping. Detected traffic movements are stored in memory 27. Controller 26 is programmed to intermittently transmit recorded traffic information to a remote monitoring station with a telephone transceiver 30, such as a cellular modem.

When a maintenance cover on the housing is opened, a time delay is activated by a tamper switch 28 positioned against the cover and connected to controller 26. An authorized technician can deactivate the delay before its expiration by operating a keyed control switch 29 connected to controller 26. If keyed control switch 29 is not operated in time, e.g., when the cover is opened by a vandal, an alert is activated. The alert may be a siren, or it may be a signal transmitted to the remote monitoring station. Panic switch 22 and speakerphone 23 connected to controller 26 can be used by drivers or pedestrians for communicating with an emergency response center through telephone transceiver 30.

FIG. 4:

Traffic monitoring device 10 is shown in a top view mounted on stop sign 14 at a street intersection. The front motion detector is arranged to detect oncoming vehicles on a road 31, preferably at about 60 feet to provide enough distance for vehicles to stop. The side motion detector is arranged to detect on a sidewalk 32 oncoming pedestrians about to cross road 31, preferably at about 10 feet. The side motion detector preferably has a field of view of about 90–100 degrees and is aligned for detecting pedestrians coming from the side as well as the front of the sign. Again, whenever motion is detected by either detector, the red lamp is flashed several times to positively alert drivers.

Figure 5:
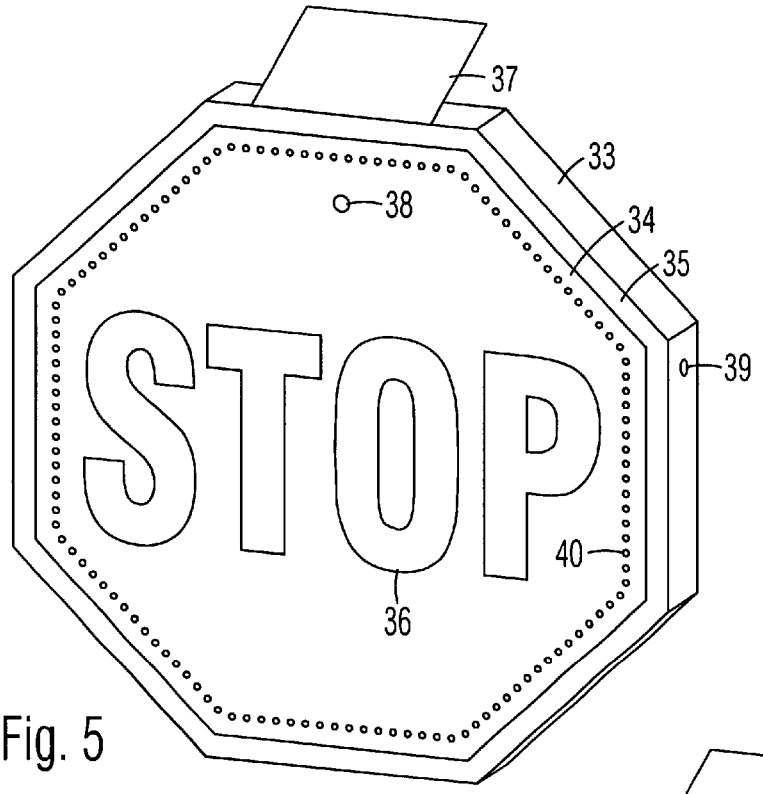
FIG. 5 is a front perspective view of a second embodiment of the traffic monitoring device.

FIG. 5:

A second embodiment of the traffic monitoring device is shown in a front perspective view in FIG. 5. It is comprised of a traffic sign shaped housing 33 for mounting to a sign post. In this example, housing 33 is in the shape of a stop sign. Housing 33 includes a red background 34, a white reflective border 35, and an insignia 36, which in this example is the word "STOP" in white. A 360° rotatable solar panel 37 is attached on top of housing 33. A front motion detector 38 and a side motion detector 39 are respectively arranged on a front and a side of housing 33. A plurality of lamps 40, which in this example are red LED's, are arranged around the perimeter of housing 33. An electrical access door is provided on the back of housing 33. Except for different reference numerals, the electrical components shown are connected to other electrical components as shown in FIG. 2. The second embodiment of the traffic monitoring device is operated in the same way as the first embodiment, except that it is for replacing instead of adding to an existing sign.

Figure 6:
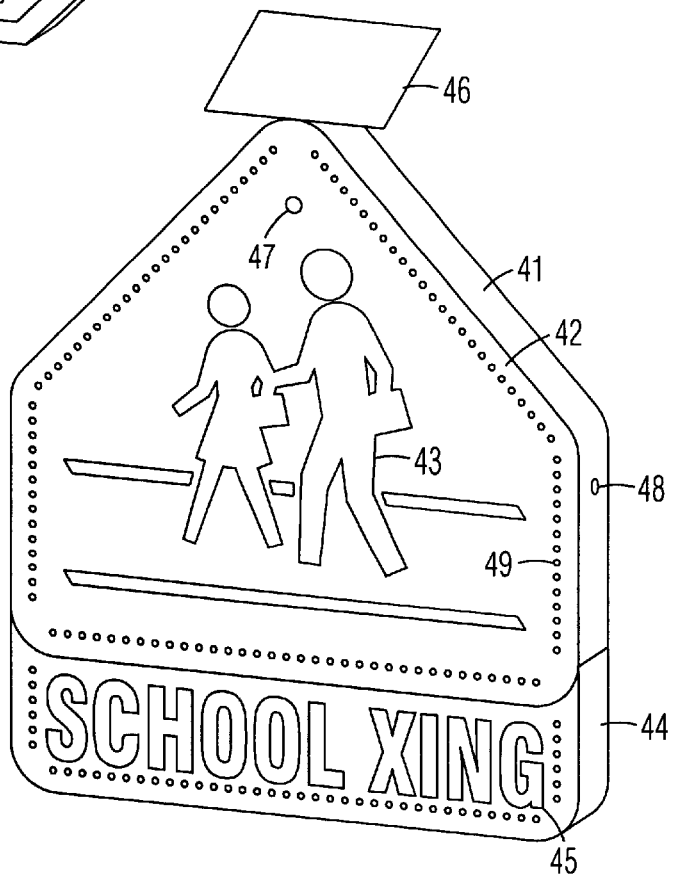
FIG. 6 is a front perspective view of a third embodiment of the traffic monitoring device.

FIG. 6:

A third embodiment of the traffic monitoring device is shown in a front perspective view in FIG. 6. It is comprised of a traffic sign shaped housing 41 for mounting to a sign post. In this example, housing 41 is in the shape of a school crossing sign. Housing 41 includes a yellow background 42, and an insignia 43, which in this example is a school crossing symbol in black. An optional housing 44 with an insignia 45 is attached to the bottom of housing 41. In this example, insignia 45 is the word "SCHOOL XING."

A 360° rotatable solar panel 46 is attached on top of housing 41. A front motion detector 47 and a side motion detector 48 are respectively arranged on a front and a side of housing 41. A plurality of lamps 49, which in this example are yellow LED's, are arranged around the perimeters of housings 41 and 44. An electrical access door is provided on the back of housing 41. Except for different reference numerals, the electrical components shown are connected to other electrical components as shown in FIG. 2. The third embodiment of the traffic monitoring device is operated in the same way as the first embodiment, except that it is for replacing instead of adding to an existing sign.

SUMMARY AND SCOPE

Accordingly, a traffic monitoring device is provided. It positively alerts drivers to the presence of a stop sign. It conveys the importance of stopping to drivers who might otherwise ignore the sign. It is self-powered. It provides an alert which is automatically activated by oncoming traffic or approaching pedestrians. It monitors and record traffic activity. It transmits the traffic activity information to a remote monitoring station. It provides a communication link for drivers or pedestrians with an emergency call center. It is tamper resistant. It is also easily retrofitted to existing stop signs.

Although the above description is specific, it should not be considered as a limitation on the scope of the invention, but only as an example of the preferred embodiment. Many variations are possible within the teachings of the invention. For example, the housing in FIG. 1 can be mounted to the sign in other ways. More or fewer motion detectors can be provided on the housing in any of the different embodiments for monitoring movement in more or fewer directions. The detection ranges of the motion detectors can be changed to suit local traffic conditions. The color of the lamps can be different. The traffic monitoring device can be mounted on or made in the shape of other types of road signs. Therefore, the scope of the invention should be determined by the appended claims and their legal equivalents, not by the examples given.

I claim:

1. A traffic monitoring device, comprising:

a motion detector for attaching to a traffic sign; and a lamp connected to said motion detector, said lamp for being visible from a front of said traffic sign, said lamp being arranged to flash in response to detection of motion by said motion detector for positively alerting drivers to said sign.

2. The traffic monitoring device of claim 1, wherein said lamp is comprised of a red lamp for meaning stop.

3. The traffic monitoring device of claim 1, further including a battery connected to said motion detector and said lamp, a charger connected to said battery, and a solar cell powering said charger, so that said traffic monitoring device is operable anywhere without being connected to a power line.

4. The traffic monitoring device of claim 1, further including memory for storing traffic information detected by said motion detector, and a telephone transceiver connected to said memory for transmitting said traffic information to a remote location.

5. A traffic monitoring device, comprising:

a vehicle motion detector for attaching to a stop sign positioned adjacent a road, said vehicle motion detector having a predetermined field of view for being generally directed along said road for detecting oncoming vehicles;

a pedestrian motion detector for attaching to said stop sign, said pedestrian motion detector having a predetermined field of view for being generally directed at a sidewalk adjacent said road for detecting oncoming pedestrians; and a red lamp connected to said vehicle motion detector and said pedestrian motion detector, said red lamp for being visible from a front of said stop sign, said red lamp being arranged for flashing in response to detection of said oncoming vehicle by said vehicle motion detector, said red lamp being arranged for flashing in response to detection of said oncoming pedestrians by said pedestrian motion detector, said red lamp flashing for positively alerting drivers to stop.

6. The traffic monitoring device of claim 5, wherein said vehicle motion detector has at least about a 60 foot range for providing enough distance for said oncoming vehicles to stop.

7. The traffic monitoring device of claim 5, wherein said field of view of said pedestrian motion detector is about 90 degrees for detecting said oncoming pedestrians at a side and said front of said stop sign.

8. The traffic monitoring device of claim 5, further including a battery connected to said vehicle motion detector, said pedestrian motion detector, and said red lamp, a charger connected to said battery, and a solar cell powering said charger, so that said traffic monitoring device is operable anywhere without being connected to a power line.

9. The traffic monitoring device of claim 5, further including memory for storing traffic information detected by said vehicular motion detector and said pedestrian motion detector, and a telephone transceiver connected to said memory for transmitting said traffic information to a remote location.

10. A traffic monitoring device, comprising:

a housing having a front bracket for positioning in front of a stop sign positioned adjacent a road, and a rear bracket for positioning behind said stop sign;

a vehicle motion detector attached to a front of said housing, said vehicle motion detector having a predetermined field of view for being generally directed along said road for detecting oncoming vehicles;

a pedestrian motion detector attached to a side of said housing, said pedestrian motion detector having a predetermined field of view for being generally directed at a sidewalk adjacent said road for detecting oncoming pedestrians;

a red lamp attached to said front bracket and positioned in front of said stop sign, said lamp being arranged for flashing in response to detection of said oncoming vehicles by said vehicle motion detector, said lamp being arranged for flashing in response to detection of said oncoming pedestrians by said pedestrian motion detector, said lamp flashing for positively alerting drivers to stop;

a controller connected to said vehicular motion detector, said pedestrian motion detector, and said red lamp;

memory connected to said controller, said memory for storing traffic information detected by said vehicular motion detector and said pedestrian motion detector;

a telephone transceiver connected to said controller for transmitting said traffic information to a remote location;

a tamper alert switch positioned against a cover on said housing and connected to said controller for detecting tampering, said tamper alert switch activating an alarm a predetermined period after said cover is opened;

a keyed control switch connected to said controller, said keyed control switch preventing said alarm from activating when said key control switch is operated before an expiration of said predetermined period;

a speakerphone connected to said controller, said speakerphone for positioning along a support post of said stop sign;

a panic switch activating said speakerphone for enabling communication with an emergency response center;

a battery supplying power to said controller;

a charger connected to said battery; and a solar cell powering said charger, so that said traffic monitoring device is operable anywhere without being connected to a power line.

11. The traffic monitoring device of claim 10, wherein said vehicle motion detector has at least about a 60 foot range for providing enough distance for said oncoming vehicles to stop.

12. The traffic monitoring device of claim 10, wherein said field of view of said pedestrian motion detector is about 90 degrees for detecting said oncoming pedestrians at a side and said front of said stop sign.

13. A traffic monitoring device, comprising:

a traffic sign shaped housing;

a traffic insignia on a front of said housing;

a front motion detector on said front of said housing for detecting oncoming vehicles; and a lamp on said front of said housing connected to said front motion detector, said lamp being arranged to flash in response to detection of said oncoming vehicles for alerting drivers.

14. The traffic monitoring device of claim 13, wherein said housing is in the shape of a stop sign, said front of said housing includes a red background, a white reflective border, and "STOP" arranged thereon.

15. The traffic monitoring device of claim 13, wherein said housing is in the shape of a school crossing sign, a front of said housing includes a yellow background, and a school crossing symbol.

16. The traffic monitoring device of claim 13, wherein said lamp is comprised of a plurality of LED's generally arranged around a perimeter of said housing.

17. The traffic monitoring device of claim 13, further including a side motion detector on a side of said housing for detecting oncoming pedestrians.

18. The traffic monitoring device of claim 13, further including a solar panel attached to said housing for providing power.

19. The traffic monitoring device of claim 13, further including a second housing attached to a bottom of said housing, said second housing including "SCHOOL XING" on a front thereof.

* * * * *